US005881432A

United States Patent [19]

Good

[11] Patent Number: 5,881,432

[45] Date of Patent: Mar. 16, 1999

[54] HANDLE FOR SHOPPING BAGS

[76] Inventor: James Richard Good, Flat 5, 69, Huron Road, London, SW17 8RG, England

[21] Appl. No.: 853,367

[22] Filed: May 8, 1997

[51] Int. Cl.[6] ..... A47B 95/02

[52] U.S. Cl. ..... 16/114 R; 294/156

[58] Field of Search ..... 16/114 R, 114 B; 294/156

[56] References Cited

U.S. PATENT DOCUMENTS

| | | | |
|---|---|---|---|
| 1,468,848 | 9/1923 | Wear | 16/114 B |
| 2,519,186 | 9/1950 | Herbert et al. | 16/114 B |
| 4,004,722 | 1/1977 | Olivier | 16/114 B |
| 5,150,938 | 9/1992 | Gans | 294/156 |
| 5,439,265 | 8/1995 | Plante | 294/156 |
| 5,735,019 | 4/1998 | Kerr et al. | 16/114 R |

*Primary Examiner*—Chuck Y. Mah
*Assistant Examiner*—Donald M. Gurley

[57] ABSTRACT

A new handle for shopping bags for supporting and retaining shopping bag handles, particularly those found on plastic bags. The inventive device includes an elongate, oval shaped member having a pair of opposite ends, a pair of opposite side edges, and a flexible central portion. A cut-out is formed adjacent each end so as to form a handle portion located at each end. The elongate member is bent about the flexible central portion into a U-shape, and the bag handles are disposed a within the interior of the U-shaped member and supported upon the central portion. The handle portions are then secured together by a snap mechanism so as to form a single carrying handle.

1 Claim, 3 Drawing Sheets

HANDLE FOR SHOPPING BAGS

BACKGROUND OF THE INVENTION

1. Field of the Invention

The present invention relates to bag supporting devices and more particularly pertains to a new handle for shopping bags for supporting and retaining shopping bag handles, particularly those found on plastic bags.

2. Description of the Prior Art

The use of bag supporting devices is known in the prior art. More specifically, bag supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bag supporting devices include U.S. Pat. No. 4,841,596; U.S. Pat. No. 4,590,640; U.S. Pat. No. Des. 337,053; U.S. Pat. No. 4,112,542; U.S. Pat. No. 5,181,757; and U.S. Pat. No. 5,029,926.

While these devices fulfill their respective, particular objectives and requirements, the aforementioned patents do not disclose a new handle for shopping bags. The inventive device includes an elongate, oval shaped member having a pair of opposite ends, a pair of opposite side edges, and a flexible central portion. A cut-out is formed adjacent each end so as to form a handle portion located at each end. The elongate member is bent about the flexible central portion into a U-shape, and the bag handles are disposed within the interior of the U-shaped member and supported upon the central portion. The handle portions are then secured together by a snap mechanism so as to form a single carrying handle.

In these respects, the handle for shopping bags according to the present invention substantially departs from the conventional concepts and designs of the prior art, and in so doing provides an apparatus primarily developed for the purpose of supporting and retaining shopping bag handles, particularly those found on plastic bags.

SUMMARY OF THE INVENTION

In view of the foregoing disadvantages inherent in the known types of bag supporting devices now present in the prior art, the present invention provides a new handle for shopping bags construction wherein the same can be utilized for supporting and retaining shopping bag handles, particularly those found on plastic bags.

The general purpose of the present invention, which will be described subsequently in greater detail, is to provide a new handle for shopping bags apparatus which has many of the advantages of the bag supporting devices mentioned heretofore and many novel features that result in a new handle for shopping bags which is not anticipated, rendered obvious, suggested, or even implied by any of the prior art bag supporting devices, either alone or in any combination thereof.

To attain this, the present invention generally comprises an elongate, oval shaped member having a pair of opposite ends, a pair of opposite side edges, and a flexible central portion. A cut-out is formed adjacent each end so as to form a handle portion located at each end. The elongate member is bent about the flexible central portion into a U-shape, and the bag handles are disposed within the interior of the U-shaped member and supported upon the central portion. The handle portions are then secured together by a snap mechanism so as to form a single carrying handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handle for shopping bags apparatus which has many of the advantages of the bag supporting devices mentioned heretofore and many novel features that result in a new handle for shopping bags which is not anticipated, rendered obvious, suggested, or even implied by any of the prior art bag supporting devices, either alone or in any combination thereof.

It is another object of the present invention to provide a new handle for shopping bags which may be easily and efficiently manufactured and marketed.

It is a further object of the present invention to provide a new handle for shopping bags which is of a durable and reliable construction.

An even further object of the present invention is to provide a new handle for shopping bags which is susceptible of a low cost of manufacture with regard to both materials and labor, and which accordingly is then susceptible of low prices of sale to the consuming public, thereby making such handle for shopping bags economically available to the buying public.

Still yet another object of the present invention is to provide a new handle for shopping bags which provides in the apparatuses and methods of the prior art some of the advantages thereof, while simultaneously overcoming some of the disadvantages normally associated therewith.

Still another object of the present invention is to provide a new handle for shopping bags for supporting and retaining shopping bag handles, particularly those found on plastic bags.

Yet another object of the present invention is to provide a new handle for shopping bags which includes an elongate, oval shaped member having a pair of opposite ends, a pair of opposite side edges, and a flexible central portion. A cut-out is formed adjacent each end so as to form a handle portion located at each end. The elongate member is bent about the flexible central portion into a U-shape, and the bag handles are disposed within the interior of the U-shaped member and supported upon the central portion. The handle portions are then secured together by a snap mechanism so as to form a single carrying handle.

Still yet another object of the present invention is to provide a new handle for shopping bags that stops the bag handles, particularly plastic bag handles, from cutting into a persons hand.

Even still another object of the present invention is to provide a new handle for shopping bags that supports the handles such that items within the bags are prevented from falling out when the bags are set down.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
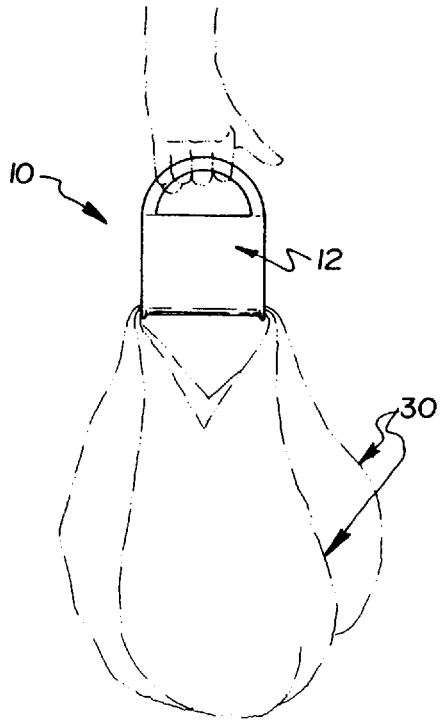
FIG. 1 is a side view of a new handle for shopping bags in use, according to the present invention.

With reference now to the drawings, and in particular to FIGS. 1 through 4 thereof, a new handle for shopping bags embodying the principles and concepts of the present invention and generally designated by the reference numeral 10 will be described.

As best illustrated in FIGS. 1 through 4, the handle for shopping bags 10 comprises an elongate, oval shaped member 12 having a pair of opposite ends 13,14, side edges 15,16, and a central portion 17. The member 12 is preferably made of plastic, and at least the central portion 17 is made flexible, such that the elongate member 12 can be bent between a flattened configuration (shown in FIG. 3), and a U-shaped configuration (shown in FIGS. 1 and 2). The member 12 is bent along its middle, about an axis extending perpendicularly to the edges 15,16, such that the sides of the "U" are symmetric.

Figure 2:
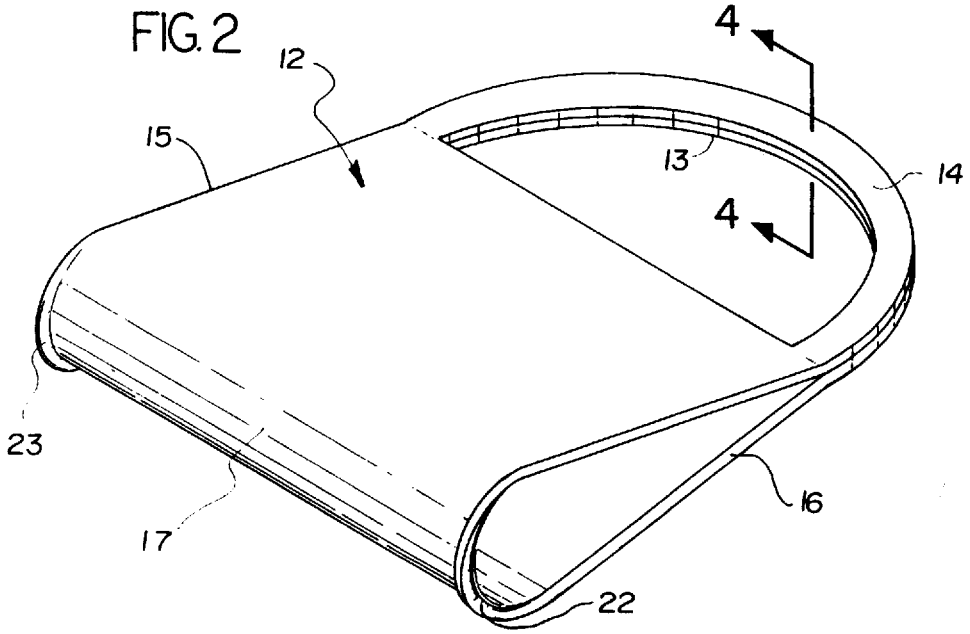
FIG. 2 is a perspective view of the handle bent into a U-shape.
Figure 3:
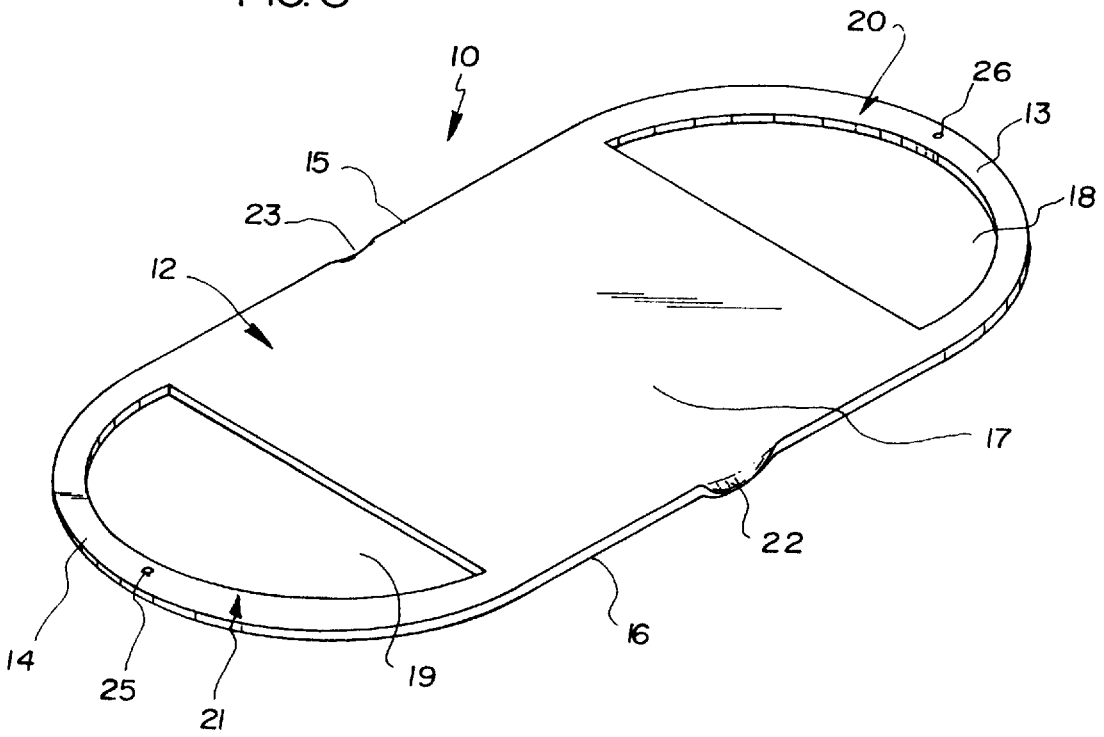
FIG. 3 is a perspective view of the handle in its unbent configuration.
Figure 5:
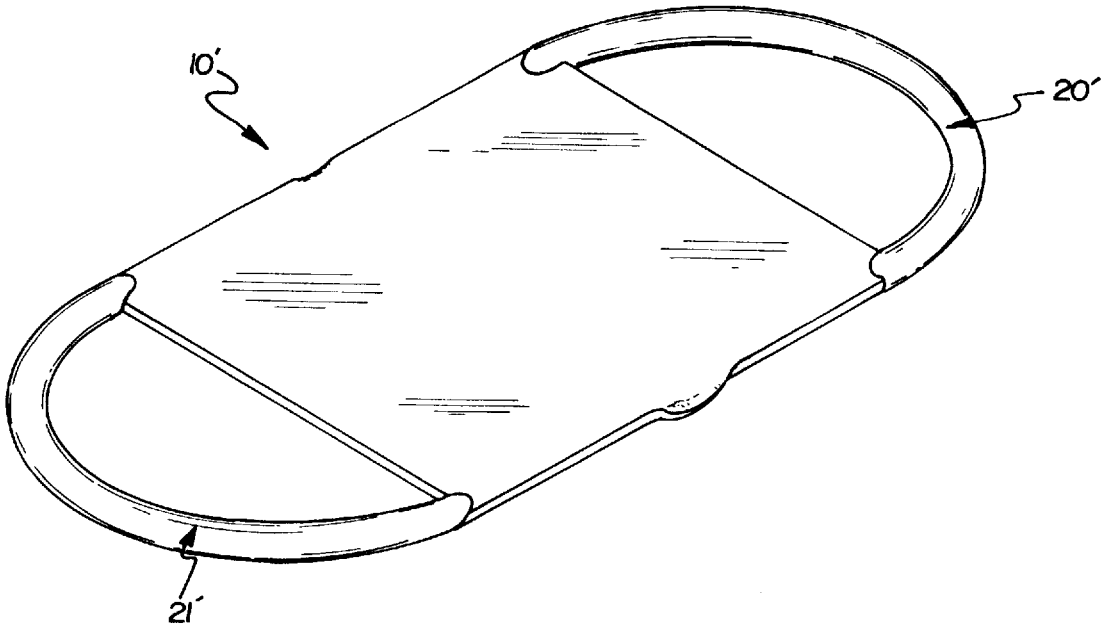
FIG. 5 shows an alternate embodiment of the handle having tubular handle portions.

As best shown in FIG. 3, the member includes D-shaped cut-outs 18,19 adjacent each of the ends 13,14 such that the material remaining between the cut-outs 18,19 and the ends 13,14 forms handle portions 20,21. The handle portions 20,21 as shown in FIGS. 2 and 3, are generally flat, arcuate members. However, as shown in FIG. 5, the handle 10' can have handle portions 20', 21' which are tubular in shape. In addition, each of the side edges 15,16 adjacent the central portion 17 is lipped 22,23 as shown, so as to distribute the weight of the bags and to prevent the edges from cutting into the handles.

As seen from FIG. 1, when the handle is bent into a U-shape, it forms an interior channel which receives the handles from the shopping bags 30 therein. The handles are supported upon the central portion 17, and the handle portions 20,21 are gripped by the person carrying the handle 10. When in the U-shape, the D-shaped cut-outs 18,19 are aligned with each other, such that the handle portions 20,21 are also aligned. A connection means is provided on the handle portions so as to secure them together to form a single handle.

Figure 4:
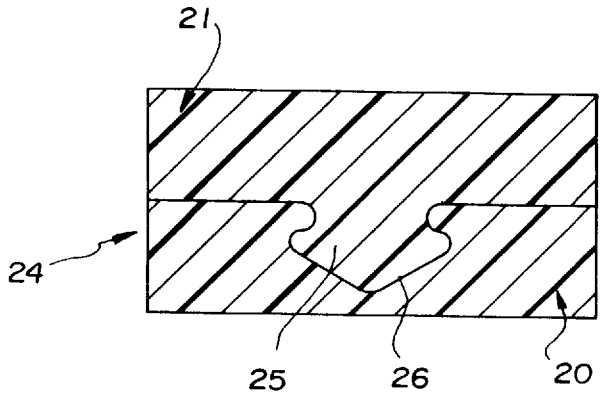
FIG. 4 is a cross sectional view taken along line 4—4 of FIG. 2.

FIG. 4 illustrates the connection means, which comprises a snap mechanism 24. The snap mechanism 24 includes a projecting male member 25 extending from the handle portion 21 which snaps into a matching female recess 26 formed in the handle portion 20. Such a mechanism is believed to be conventional and is not further discussed. A similar mechanism is also used with the tubular handles 20', 21' in FIG. 5. Although the member 25 and recess 26, are shown and described as being on the handle portions 21,20 respectively, it should be realized that the member 25 could be formed on the handle portion 20 and the recess 26 formed on the handle portion 21 without changing the scope of the invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag carrier for lifting a plurality of bags that include loops attached to the bags for allowing the bags to be carried in a person's hand, comprising:

an oval shaped elongate member constructed from a substantially uniformly thick flexible plastic having a pair of oppositely disposed arcuately-shaped ends, a pair of opposite linear side edges, and a flexible central portion, wherein the side edges adjacent said flexible central portion each includes a lip with a semicircular outboard edge and a semicircular inboard edge integrally coupled to the elongate member, each lip extending downwardly and outwardly with respect to the elongate member in generally perpendicular relationship therewith for reducing wear between the side edges and a portion of a bag extending across the side edges is minimized, wherein a thickness of each lip tapers at ends thereof;

a D-shaped cut-out formed in the elongate member adjacent each end thereof so as to form a handle portion at each end for insertion of the hand of a user therethrough, wherein a linear portion of each of the D-shaped cut-outs being positioned inwardly toward a center of the elongate member and wherein an arcuate portion of each of the D-shaped cut outs is positioned outwardly towards the arcuately shaped ends to provide a arcuate handle portion with a substantially uniform width for enhancing hand comfort of the user of the elongate member, wherein each handle portion has a separate tubular configuration; and a snap mechanism including a recess formed in an apex of a first one of the handles and a protrusion formed in an apex of a second one of the handles with both the recess and the protrusion having an enlarged conical portion and a reduced annular recess portion, the snap mechanism adapted for connecting said handle portions together in an aligned position relative to each other to form a single handle when said elongate member is bent about the flexible central portion into an approximate U-shape having an interior such that the loops may be fitted within the interior and supported upon the flexible central portion.

* * * * *